United States Patent [19]

Jörg

[11] Patent Number: 4,936,521

[45] Date of Patent: Jun. 26, 1990

[54] DEVICE FOR AUTOMATICALLY CLAMPING MOVING, AND RELEASING A SPOOL

[75] Inventor: Karl Jörg, Georgensgmünd, Fed. Rep. of Germany

[73] Assignee: Maschinenfabrik Niehoff GmbH & Co. KG, Schwabach, Fed. Rep. of Germany

[21] Appl. No.: 292,768

[22] Filed: Jan. 3, 1989

[30] Foreign Application Priority Data

Dec. 31, 1987 [DE] Fed. Rep. of Germany ..... 3744600

[51] Int. Cl.[5] ..... B65H 54/02

[52] U.S. Cl. ..... 242/54 R; 57/272; 57/273

[58] Field of Search ..... 242/54 R, 25 R, 47, 242/82, 35.5 A, 46; 57/272, 273, 71

[56] References Cited

U.S. PATENT DOCUMENTS

| | | | |
|---|---|---|---|
| 520,943 | 6/1894 | Stevenson, Jr. et al. | 242/82 |
| 2,338,848 | 1/1944 | Henning et al. | 57/71 |
| 2,367,237 | 1/1945 | Pape | 57/272 X |
| 4,389,838 | 6/1983 | Adelhard et al. | 57/71 |
| 4,398,677 | 8/1983 | Henrich | 242/25 R |
| 4,685,631 | 8/1987 | Kurtz et al. | 242/47 |
| 4,714,209 | 12/1987 | Allard | 242/25 R |

FOREIGN PATENT DOCUMENTS

| | | | |
|---|---|---|---|
| 480432 | 2/1938 | United Kingdom | 57/71 |

*Primary Examiner*—Donald Watkins
*Attorney, Agent, or Firm*—Kenyon & Kenyon

[57] ABSTRACT

In a winding machine where material is wound onto a non-rotating spool by a flyer that revolves around the spool, a device for moving, clamping, and releasing the spool moves the spool into position for winding, traverses the spool axially as the flyer rotates around the spool to properly distribute the material on the spool, and moves the spool away from the winding position. The device also clamps the spool as it moves the spool into position for winding and unclamps the spool as it moves the spool away from the winding position.

18 Claims, 4 Drawing Sheets

DEVICE FOR AUTOMATICALLY CLAMPING MOVING, AND RELEASING A SPOOL

FIELD OF THE INVENTION

The present invention relates to the field of automatic material winding machines. More specifically it relates to devices for clamping, raising, lowering, and releasing spools upon which materials are to be wound, where the spools are non-rotating and the materials are fed onto the spool by an orbiting flyer.

BACKGROUND OF THE INVENTION

Devices which grasp and release the spools used in automatic winding machines are known. For the most part these devices require such supply lines as electrical cables, hydraulic lines or pneumatic lines. These cables and/or supply lines have a limited life time due to the constant up and down movement of the spool and the clamping fixture. Breakdowns of these devices are a particular problem as the spools upon which the material is wound can be accidentally released.

In German Published Application No. 28 08 075 a mounting support for the winding spool of a bobbin winder is described, the spool being supported by the spreading of clamping elements or by a pressing mechanism which shifts a rod axially.

It is an object of the present invention to provide a device which will automatically grasp a spool, maintain that grasp during winding operations, and release the grasp automatically once the spool is fully wound, the device performing these operations without supply lines of any type.

SUMMARY OF THE INVENTION

These objects and other objects are achieved in the present invention wherein a lifting mechanism is provided, the lifting mechanism capable of vertical movement only, not rotary. Incorporated within the lifting mechanism is a clamping mechanism sized to fit within the bores of the spools upon which material is to be wound. As the lifting mechanism rises, the clamping mechanism inserts into the bore of the spool. As the lifting mechanism continues to rise to its initial operating position, the clamping mechanism deploys within the bore, securely grasping the spool. During winding operations the spool is moved up and down between the lower, initial operating position and the upper, final operating position. The clamping mechanism remains activated during this up and down motion. After winding is complete, the lifting mechanism lowers the spool. As the lifting mechanism drops below the initial operating position, the clamping mechanism gradually releases the spool. Finally, the lifting mechanism comes to rest in its neutral position.

In the invention just described, the clamping occurs in an automatic and self-locking manner, preventing accidental release of the spools. External supply lines are not needed, avoiding the necessity of exposing those lines to constant motion in the work area where the winding material is placed on the spools. The clamping and releasing occurs as a function of the raising and lowering of the spool itself, avoiding the need for outside control lines also.

The invention is especially suited for automatic spool changing where the spool's central axis is arranged vertically. This arrangement permits the spool to be clamped on only one side of the spool borehole, in conjunction with a flat faceplate for concentric holding. In this arrangement only a short shaft extension is necessary. If the spool's central axis were arranged along the horizontally, one-sided clamping would not suffice.

Other characteristics, details, advantages and uses of the present invention will be explained in the following specification in conjunction with the figures wherein:

DETAILED DESCRIPTION

Figure 1:
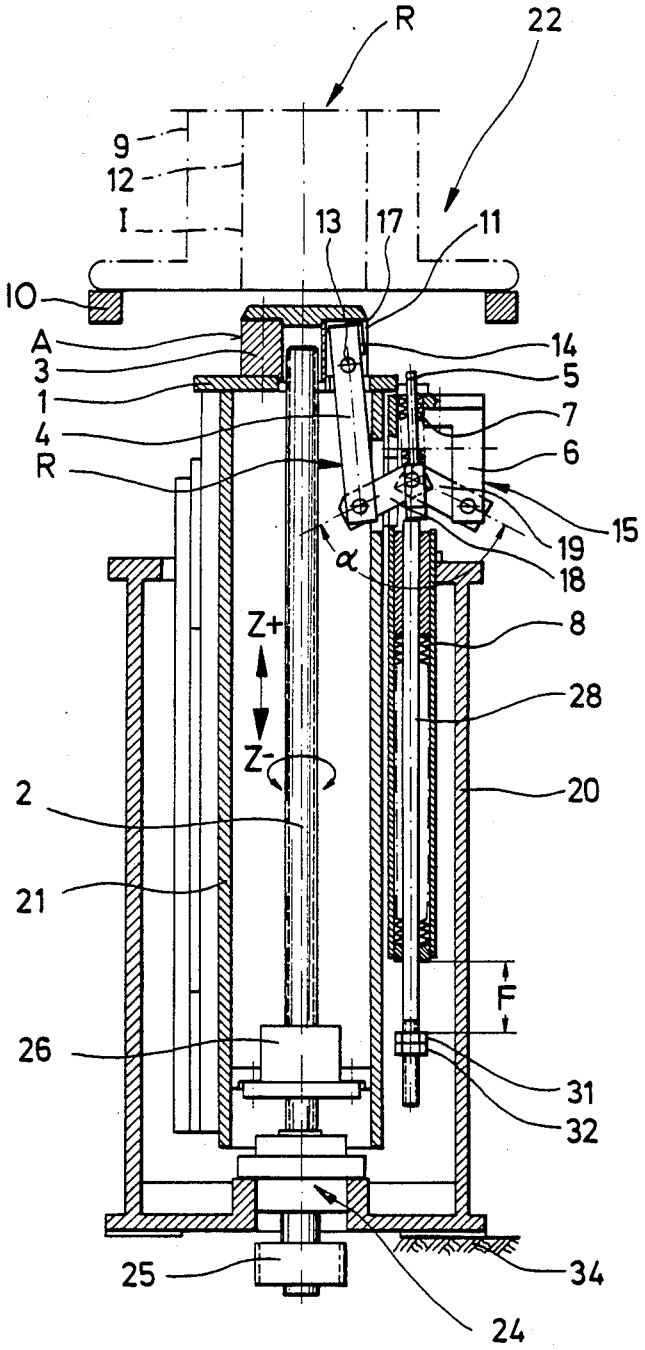
FIG. 1 is a longitudinal cross section of the present invention in a neutral or spool-releasing position.
Figure 2:
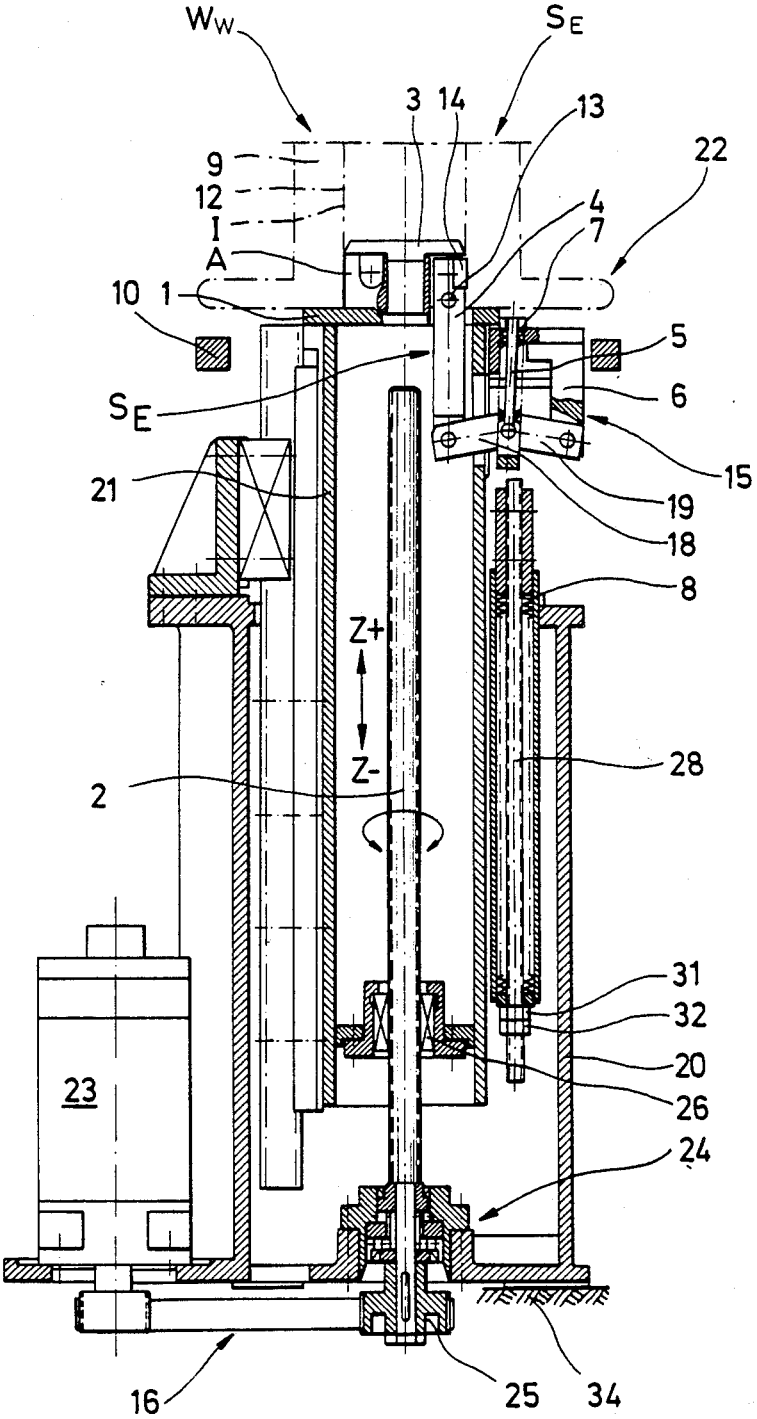
FIG. 2 is a longitudinal cross section of the present invention in an operating or spool-clamped position.
Figures 3, 4, 5, 6:
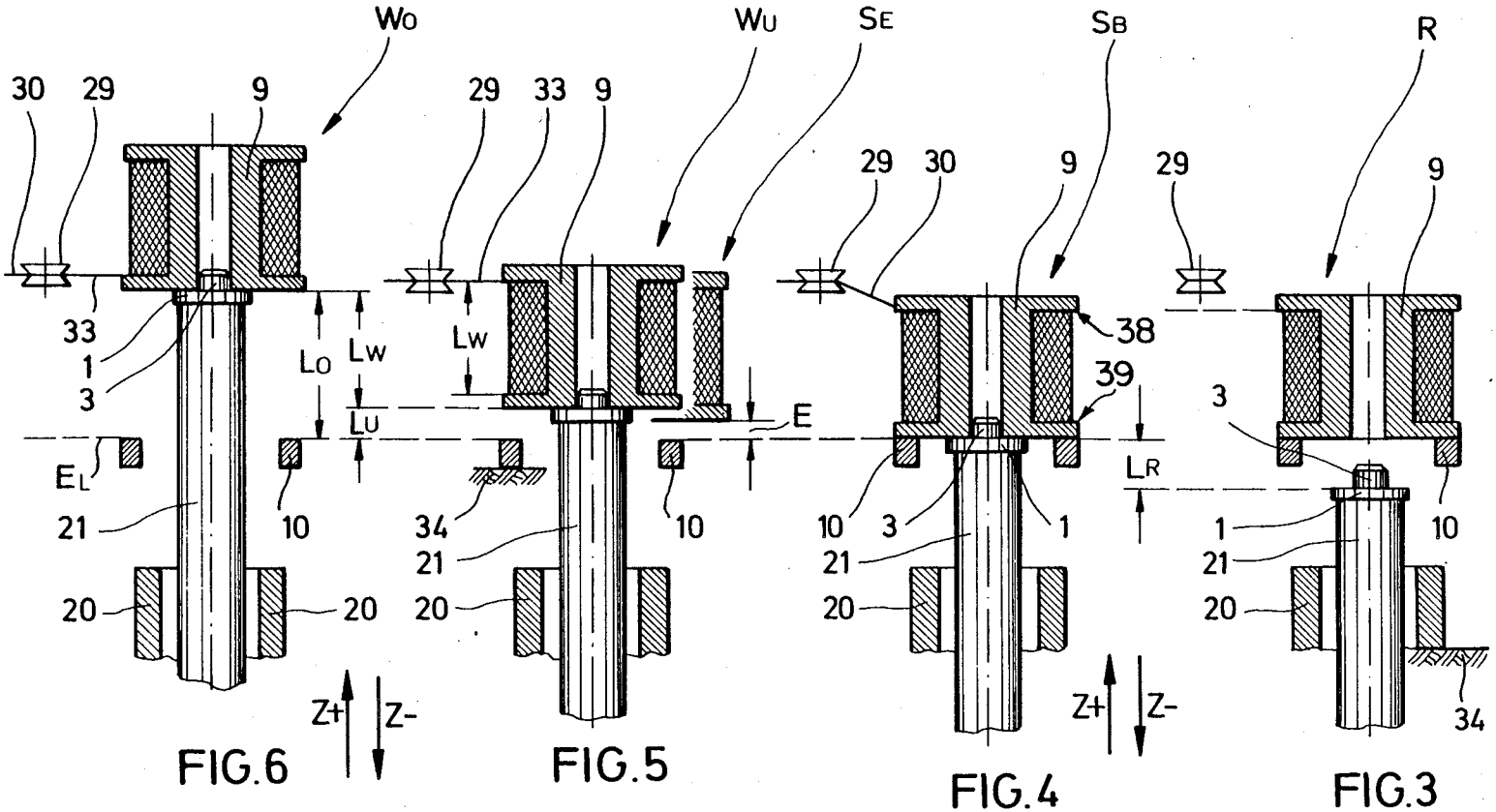
FIG. 3 is a detail of the spool holder of the present invention in a neutral position.
FIG. 4 is a detail of the spool holder of the present invention in an operating position.
FIG. 5 is a detail of the spool and spool holder in the lower initial operating position.
FIG. 6 is a detail of the spool and spool holder in the upper, final operating position.

Spool 9 which receives the material to be wound is shown in FIGS. 1 to 6. As seen in FIG. 1, the spool is moved up and down along vertical axis Z by the present invention. Wire winder 29, visible in FIGS. 3 through 6, dispenses the material 30 to be wound onto the spool. The wire winder can be a stationary roller or, in another embodiment, it can revolve about the spool. In the instance where the wire winder is stationary, the spool must rotate about its own axis. In the embodiment described herein the wire winder revolves about the spool. The wire winder has a fixed plane of rotation, numbered 33 in FIGS. 5 and 6. $L_w$, seen in FIGS. 5 and 6, represents the width of the spool upon which material is to be wound. This width $L_w$ is equal to the distance that the present apparatus moves the spool up and down through during the winding operation. During the winding operation itself, lower lip 39 of spool 9 rises at its maximum to the same height as the plane of rotation 33 and upper lip 38 of spool 9 lowers at most to that same plane of rotation 33.

Lifting mechanism 21, shown in FIG. 1, upon rising along the Z axis in the Z+ direction automatically grasps spool 9. It then continues rising until lip 38 reaches rotation plane 33, whereupon winding begins. During winding, lifting mechanism 21 raises and lowers the spool through distance $L_w$, the rate of the vertical movement being coordinated with the revolution rate of winder 29 to obtain the desired distribution of material on the spool. When apparatus 16 lowers the spool after winding has been completed, the spool is automatically released, allowing replacement of the spool and new winding operations.

As shown in FIGS. 1 and 2, spool 9 is supported by spool stand 10, which stand has a central circular opening and which is permanently mounted on base 34. Spool stand 10's upper surface is defined as bearing plane $E_L$. Housing 20 is also secured permanently to base 34, below spool stand 10, the housing's central axis being aligned with the central axis of the circular opening in stand 10. Lifting element 21 is mounted within housing 20 and is capable of vertical motion along the Z axis. The upper portion of lifting element 21 has a spool holder 1 which, when lifting element 21 is fully lowered, lies below bearing plane $E_L$. During operation, the spool holder extends a variable distance above bearing plane $E_L$.

Lifting element 21 is raised and lowered by sliding apparatus 16, which apparatus comprises a threaded spindle 2 and associated driving mechanism. Spindle 2 mounts within housing 20, spindle 2's axis being colocated with the housing's Z axis. Spindle 2 pivots on bearing 24, which is also mounted within housing 20. Spindle 2 is driven by motor 23 through transmission element 25. Transmission element 25 may be a driving pinion, a friction roller or similar device. Spindle nut 26, which is permanently coupled to lifting element 21, operatively connects spindle 2 to the lifting element. In operation, rotary motion is transmitted from motor 23 to spindle 2 by means of transmission element 25. Through a screw-like fixture on spindle 2 and spindle nut 26, this rotary motion is converted to vertical motion in a known fashion.

Figure 9:
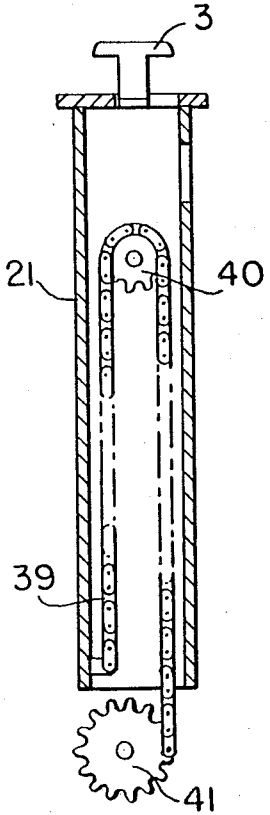
FIG. 9 is a detail of the lifting mechanism of the present invention showing a chain drive to actuate the lifting mechanism.
Figure 8:
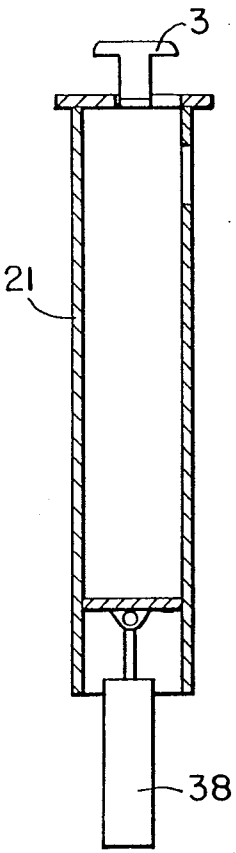
FIG. 8 is a detail of the lifting mechanism of the present invention showing a hydraulic actuator to actuate the lifting mechanism.
Figure 7:
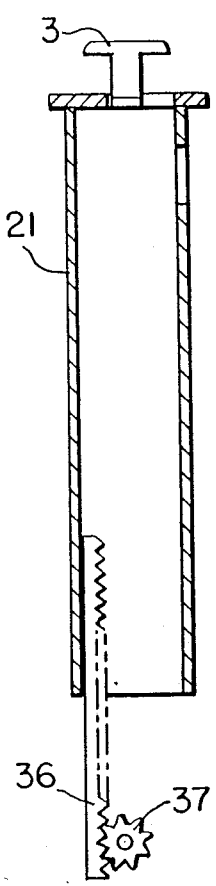
FIG. 7 is a detail of the lifting mechanism of the present invention showing a rack-and-pinion drive to actuate the lifting mechanism.

There is, of course, no necessity for using a screw-type lifting arrangement for lifting element 21. The element can be moved up and down by such means as a hydraulic cylinder as shown in FIG. 8, a rack-and-pinion drive with rack 36 and pinion 37, as shown in FIG. 7, a chain drive with chain 39, pulley 40, and gear 41, as shown in FIG. 9, or other linear drives.

Lifting element 21 is shown in its lowest or neutral R position in FIGS. 1 and 3. Spool retainer 3, which is located on the upper end of spool holder 1, is situated a distance $L_R$ below bearing plane $E_L$ when the lifting element is in neutral position R. By rotating spindle 2 in the appropriate direction, lifting element 21 and attached spool retainer 3 are raised from neutral position R upwards until a spool 9, previously placed on spool stand 10, is engaged by spool retainer 3. As the lifting process continues and spool 9 moves from position $S_B$ (FIG. 4) to spool position $S_E$ (where the base of the spool is distance $L_E$ above bearing plane $E_L$), shown in FIGS. 2 and 5, spool 9 is clamped by an automatic clamping device 15. Spool 9 has therefore been clamped to the lifting device 21 before the spool is lifted distance $L_u$ from bearing plane $E_L$ to spool position $W_u$, which is the lowest position at which material is wound onto the spool.

The components that comprise the automatic clamping device are shown in FIGS. 1 and 2. Spool holder 1 and gripping lever 4, both components being coupled to lifting element 21, are shown in neutral position R in FIG. 1. Lifting element 21 also forms part of automatic clamping device 15. Gripping lever 4 is supported in recess 17 of the spool retainer by means of pivot pin 13. Gripping lever 4 does not protrude beyond the side of spool retainer 3 when in neutral position R. However, when gripping the spool, an active component side piece 14 of lever 4 does extend beyond the sides of spool retainer means 3. Lever 4 is capable of pivoting about pivot pin 13 in a manner which allows the protuberance of active side component side piece 14.

The other end of lever 4 is coupled by a pivot pin to first side bar 18. The other end of side bar 18 is coupled by a pivot pin to control member 5. Second side bar 19 is also coupled to control member 5 by the same pivot pin which couples bar 18 to control member 5. The other end of side bar 19 is coupled to angular bearing block 6, which is arranged on lifting element 21, by another pivot pin.

Spring 7, which is placed around control member 5, is a compression spring. This arrangement of gripping lever 4, side bars 18 and 19, spring 7, and control member 5 forms compound lever arrangement 22.

Looking at arrangement 22 in isolation, in neutral position R, side bars 18 and 19's longitudinal axes form an angle $\alpha$ with relation to one another. When control member 5 is pressed downward by spring 7, the angle $\alpha$ increases, until the bars reach the position $S_E$ shown in FIGS. 2 and 5. This movement applies an upwards force to gripping lever 4, which in turn pivots about pivot pin 13. As gripping lever 4 moves about pivot pin 13, active component 14 of lever 4 penetrates in a radial direction a radial perforation 11 of spool retainer 3. As the active component protrudes through the perforation it grips the inner wall of bore hole 12 in spool 9.

Figure 10:
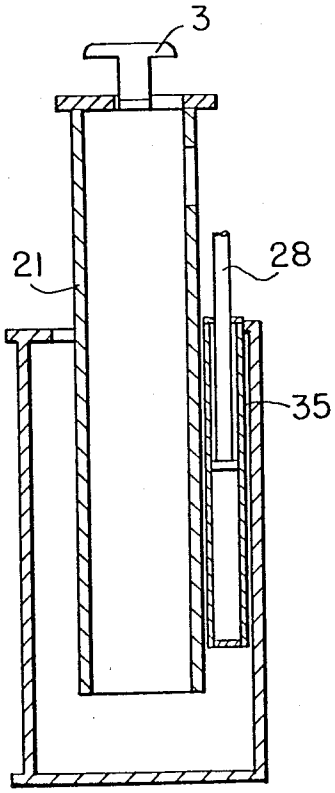
FIG. 10 is a detail of the spring-loaded impacting rod of the present invention.

The change of position of gripping lever 4 effected by spring 7 described above is caused by the vertical motion of lifting element 21. A spring-loaded impacting rod 28 is mounted on housing 20 either in an oil or gas pressure cylinder 35, shown in FIG. 10, or in a spring leg 8, and is located so as to be in axial alignment with control member 5. In the neutral R position, the upper end of spring-loaded impacting rod 28 pushes control member 5 upwards with sufficient force to overcome spring 7. This in turn insures that lever 4 is in its lower, unprotruding position. As lifting element 21 is raised upwards, it carries compound lever arrangement 22 with it. As lever arrangement 22 moves away from rod 28, the spring loading of rod 28 maintains contact between control member 5 and rod 28. Contact is maintained over a distance F (FIG. 1) until the internal spring action of pressure cylinder 35 or spring leg 8 is fully extended. Once rod 28 no longer pushes control member 5 upward, spring 7 urges control member 5 downward, with the result described in the previous paragraph. The distance that rod 28 can move is determined by adjusting nut 31, shown in its unseated position in FIG. 1 and seated in FIG. 2 and fixed in position by locking nut 32.

Although the individual elements which comprise the present invention have now been described, a better understanding of the invention will be produced by describing its full operation.

Prior to the start of the winding process a spool 9 is placed on stand 10 so that the circular axial bore 12 of inner diameter I is placed over the opening through which spool retainer 3 and attached lifting element 21 will extend.

Upon an appropriate control signal, motor 23 is turned on and lifting element 21 with attached lever arrangement 22 begins to move upwards. As these elements move upward, rod 28 applies less and less pressure to control member 5 and control member 5 begins to move downwards.

Once the lifting element 21 rises high enough so that spool retainer means 3, with outer diameter A equal to the inner diameter I of bore 12, protrudes into bore 12, rod 28 no longer presses on member 5. As member 5 extends downwards, driving side bars 18 and 19 further apart, lever 4 pivots outward, forcing active element 14 to protrude beyond the side of spool retainer means 3 and into bore 12 of spool 9. Lifting element 21 continues to move upward until lip 38 of spool 9 reaches the level of flyer 29. At this point winding begins, after the material to be wound is affixed to spool 9. This procedure can be accomplished either automatically or manually.

During the winding process, lifting element 21 is driven up and down between an upper limit $W_o$ (where the base of the spool is distance $L_o$ from bearing plane $E_L$, shown in FIG. 6) and a lower limit $W_u$ (FIG. 5). The rate of travel between these extremes is determined by the rate at which material is fed onto spool 9, the type of material 30 and the desired distribution on spool 9. These can be determined in a known manner. The reversal of travel of lifting element 21 is accomplished by appropriate control signals to motor 23, the signals either reversing the direction of motor travel or changing the gearing in transmission 16. When lifting element 21 is actuated by means of a hydraulic cylinder, the latter is controlled by reversing the impact on both sides of the piston in both directions of motion.

Once winding is complete, lifting element 21 is lowered through the point where active element 14 releases spool 9 until element 21 reaches neutral position R.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. In a winding machine comprising:

a non-rotatable spool having an axis;

a flyer supported to revolve around the spool at a fixed axial position to wind material onto the spool; and means for moving the spool along the axis to distribute material over the length of the spool between a first and a second end position as it is wound by the flyer, a device to clamp and release the spool comprising:

means for moving the spool beyond at least one of the first and second end positions; and means for clamping the spool to the means for moving operable to clamp the spool to the means for moving when the spool is between the first and second end positions and to release the spool when beyond at least one end position.

2. The device of claim 1 wherein the winding machine further includes a spool stand holding the spool when not in use and the device further comprises:

a base supporting the means for moving;

a housing surrounding the means for moving and fixed to the base; and a permanently-arranged impacting rod attached to the housing, the means for moving comprises:

a lifting element lifting the spool from the spool stand and moving it between the first and second end positions; and a sliding mechanism actuating the lifting element, and the means for clamping comprises:

a spool retainer mounted on the end of the lifting element; and a clamping device contained within the spool retainer, the spool retainer includes an actuating element in operative contact with the impacting rod when the spool retainer is beyond the first end position and not in contact with the spool and disengaging from the impacting rod when the spool retainer is brought into contact with the spool by the lifting element and moved to the first end position, the actuating element actuating the clamping device to clamp the spool before the spool is moved by the lifting element to the first end position, to maintain the clamping action while the spool is being wound, and to release the spool when the lifting element moves the spool away from the first end position after winding is completed.

3. The device of claim 2 wherein the impacting rod is spring-loaded and supported by a spring leg attached to the housing.

4. The device of claim 2 wherein the impacting rod is spring-loaded and supported within an oil or gas pressure cylinder attached to the housing.

5. The device of claim 2 wherein the spool has a central circular bore and is supported on the spool stand when not in use so that the axis of the spool's bore coincides with the axis of the spool retainer, the inside diameter of the spool's bore corresponds to the outside diameter of the spool's retainer, the clamping device automatically grips the bore of the spool as the lifting element moves the spool toward the first end position, retains the grip on the bore of the spool as the means for moving traverses the spool between the first and second end positions during winding, and releases the spool as the means for moving moves the spool away from the first end position after winding but before the spool is brought to rest on the spool stand.

6. The device of claim 2 wherein the spool retainer comprises:

a gripping lever;

an active gripper mounted on one end of the gripping lever;

the gripping lever mounted within the spool retainer, protruding from the spool retainer when the device has moved the spool away from the spool stand and not protruding when the spool is resting on the spool stand;

a spring-loaded control member;

a first side bar, one end of which is pivotally coupled to the end of the gripping lever opposite the active gripper and the other end of which is pivotally coupled to the control member;

a second side bar, one end of which is pivotally coupled to the control member and the other end of which is pivotally coupled to the lifting element; and the impacting rod interacts with the control member so that the separation of the control member and impacting rod caused by the motion of the lifting element allows the control member to move both the first and second side bars, the movement of which in turn forces the active gripper to grip the bore of the spool.

7. The device of claim 6 wherein the impacting rod is adjustable to provide varying force on the control member.

8. The device of claim 2 wherein the sliding mechanism is a threaded spindle drive.

9. The device of claim 8 wherein the threaded spindle drive comprises:

a threaded spindle, supported for rotary motion, fixed to the housing;

a driving mechanism coupled to the threaded spindle and rotating the threaded spindle in either direction of rotation; and a coupling device attached to the threaded spindle and the lifting element capable of converting the rotary motion of the threaded spindle into axial motion of the lifting element.

10. The device of claim 2 wherein the sliding mechanism is a hydraulic actuator.

11. The device of claim 2 wherein the sliding mechanism is a rack-and-pinion drive.

12. The device of claim 2 wherein the sliding mechanism is a chain drive.

13. The device of claim 5 wherein the spool retainer comprises:

a gripping lever;

an active gripper mounted on one end of the gripping lever;

the gripping lever mounted within the spool retainer, protruding from the spool retainer when the device has moved the spool away from the spool stand and not protruding when the spool is resting on the spool stand;

a spring-loaded control member;

a first side bar, one end of which is pivotally coupled to the end of the gripping lever opposite the active gripper and the other end of which is pivotally coupled to the control member;

a second side bar, one end of which is pivotally coupled to the control member and the other end of which is pivotally coupled to the lifting element; and the impacting rod interacting with the control member so that the separation of the control member and impacting rod caused by the motion of the lifting element allows the control member to move both the first and second side bars, the movement of which in turn forces the active gripper to grip the bore of the spool.

14. The device of claim 13 wherein the sliding mechanism is a threaded spindle drive.

15. The device of claim 14 wherein the threaded spindle drive comprises:

a threaded spindle, supported for rotary motion, fixed to the housing;

a driving mechanism coupled to the threaded spindle and rotating the threaded spindle in either direction of rotation; and a coupling device attached to the threaded spindle and the lifting element capable of converting the rotary motion of the threaded spindle into axial motion of the lifting element.

16. The device of claim 13 wherein the sliding mechanism is a hydraulic actuator.

17. The device of claim 13 wherein the sliding mechanism is a rack-and-pinion drive.

18. The device of claim 13 wherein the sliding mechanism is chain drive.

* * * * *

UNITED STATES PATENT AND TRADEMARK OFFICE

CERTIFICATE OF CORRECTION

PATENT NO. : 4,936,521

DATED : June 26, 1990

INVENTOR(S) : Karl Jörg

It is certified that error appears in the above-identified patent and that said Letters Patent is hereby corrected as shown below:

In Column 2, line 3, delete "along the"

line 65, change "When apparatus 16 lowers" to --When lifting mechanism 21 lowers--

Column 3, line 35, change "hydraulic cylinder" to --hydraulic cylinder 38,--

Column 8, line 32, claim 18, change "is chain" to --is a chain--

Signed and Sealed this

Twenty-first Day of July, 1992

*Attest:*

DOUGLAS B. COMER

*Attesting Officer*

*Acting Commissioner of Patents and Trademarks*